US010674566B2

(12) United States Patent
Okajima et al.

(10) Patent No.: US 10,674,566 B2
(45) Date of Patent: Jun. 2, 2020

(54) PLANAR HEATER

(71) Applicant: CoorsTek KK, Tokyo (JP)

(72) Inventors: Hiroyuki Okajima, Yamagata (JP); Kanta Doi, Yamagata (JP)

(73) Assignee: COORSTEK KK, Shinagawa-Ku, Tokyo (JP)

( * ) Notice: Subject to any disclaimer, the term of this patent is extended or adjusted under 35 U.S.C. 154(b) by 531 days.

(21) Appl. No.: 15/447,761

(22) Filed: Mar. 2, 2017

(65) Prior Publication Data

US 2018/0255612 A1 Sep. 6, 2018

(51) Int. Cl.
*H05B 3/14* (2006.01)
*H05B 3/22* (2006.01)

(52) U.S. Cl.
CPC ..... *H05B 3/145* (2013.01); *H05B 3/22* (2013.01); *H05B 2203/014* (2013.01)

(58) Field of Classification Search
CPC ..... H05B 3/145; H05B 3/22; H05B 2203/014
USPC ..... 118/725, 728, 724; 219/553, 541, 444.1, 219/458.1
See application file for complete search history.

(56) References Cited

U.S. PATENT DOCUMENTS 6,043,468 A * 3/2000 Toya ..... C30B 15/14 219/544
6,204,488 B1 * 3/2001 Toya ..... F27D 99/0073 219/444.1
7,658,801 B2 * 2/2010 Arami ..... F27B 5/04 118/724
8,071,920 B2 * 12/2011 Shimanuki ..... H05B 3/143 219/443.1
8,203,104 B2 * 6/2012 Komatsu ..... C23C 16/4581 219/444.1
2002/0001460 A1 * 1/2002 Seko ..... H01L 21/67103 392/407

(Continued)

FOREIGN PATENT DOCUMENTS

JP H10-46515 A 2/1998
JP 2000-173923 A 6/2000

(Continued)

OTHER PUBLICATIONS

Office Action issued by the Korean Patent Office in corresponding Korean Patent Application No. 10-2017-0005939 dated Jun. 22, 2018 (4 pages).

(Continued)

*Primary Examiner* — Jimmy Chou
(74) *Attorney, Agent, or Firm* — Buchanan Ingersoll & Rooney PC

(57) ABSTRACT

Provided is a planar heater in which a carbon wire heat generator is housed in along quartz glass housing portion, and the planar heater suppresses disconnection of the carbon wire heat generator by limiting a contact region between the carbon wire heat generator and the long housing portion, and capable of efficient radiation heating. In the planar heater, the plurality of long housing portions is disposed on the same plane, and heat is generated by energizing the carbon wire heat generator, each of the plurality of long housing portions is formed in a polygonal circular arc shape in which a plurality of linear portions is connected at a bent portion, respectively, and the plurality of long housing portions is disposed along the circumferences of a plurality of concentric circles.

5 Claims, 5 Drawing Sheets

(56) References Cited

U.S. PATENT DOCUMENTS

2004/0021475 A1* 2/2004 Ito ..... G01R 31/2886 324/755.01
2004/0211772 A1* 10/2004 Park ..... H05B 3/04 219/548
2006/0000822 A1* 1/2006 Nakamura ..... H01L 21/67103 219/409
2008/0017632 A1* 1/2008 Maki ..... H01L 21/67103 219/543
2008/0049374 A1* 2/2008 Morioka ..... H01L 21/6831 361/234
2008/0266745 A1* 10/2008 Nobori ..... H01L 21/6831 361/234
2009/0095731 A1* 4/2009 Asakura ..... C23C 16/4586 219/438
2009/0095733 A1* 4/2009 Komatsu ..... C23C 16/4581 219/521
2010/0132615 A1* 6/2010 Kato ..... C23C 16/402 118/725
2010/0163188 A1* 7/2010 Tanaka ..... H01L 21/67103 156/345.52
2010/0224620 A1* 9/2010 Shibata ..... H01L 21/67103 219/460.1
2010/0243635 A1* 9/2010 Nakamura ..... F23Q 7/22 219/270
2010/0326600 A1* 12/2010 Park ..... H01J 37/32091 156/345.37
2011/0005686 A1* 1/2011 Tanaka ..... H01L 21/68757 156/345.52
2013/0175257 A1* 7/2013 Lee ..... H05B 3/265 219/552
2013/0200067 A1* 8/2013 Hirano ..... C04B 35/645 219/544
2015/0245415 A1* 8/2015 Wang ..... H05B 3/24 219/217

FOREIGN PATENT DOCUMENTS

JP 2001-332373 A 11/2001
JP 2003-77783 A 3/2003
KR 10-2010-0138580 A 12/2010

OTHER PUBLICATIONS

Office Action issued by the Korean Patent Office in corresponding Korean Patent Application No. 10-2017-0005939 dated Dec. 18, 2017 (4 pages).

* cited by examiner

PLANAR HEATER

BACKGROUND OF THE INVENTION

Field of the Invention

The present invention relates to a planar heater, for example, a planar heater in which a carbon wire heat generator is housed in a quartz glass tube.

Description of the Related Art

Japanese Unexamined Patent Application Publication No. 2001-332373 discloses a planar heater 60 as illustrated in FIG. 7. The planar heater 60 illustrated in FIG. 7 has a quartz glass support member 61 having a plate shape, and one surface side of the quartz glass support member 61 serves as a heating surface having a flat disk shape.

A groove-like space (not shown) is formed inside the quartz glass support member 61, and a carbon wire heat generator W is wired in the groove-like space in a zigzag pattern shape. Sealing terminals (not shown) are connected to both ends of the carbon wire heat generator W, respectively, and an inert gas is injected and sealed in the space.

Further, the quartz glass support member 61 has a structure that is integratedly fused except for the groove-like space.

The carbon wire heat generator disclosed in Japanese Unexamined Patent Application Publication No. 2001-332373 is smaller heat capacity than a metal heat generator or the like and has better temperature rise/fall characteristics, and also has better high-temperature durability in a non-oxidizing atmosphere. In addition, because the carbon wire heat generator is manufactured by knitting a plurality of thin carbon single fiber bundles, there are advantages in which the carbon wire heat generator has improved shape flexibility compared to a heat generator made of solid carbon material and can be easily manufactured into various structures and shapes.

Therefore, a heater in which the heat generator is enclosed together with a non-oxidizing gas in a clean heat-resistant support member such as a high-purity quartz glass member does not generate particles or the like and is extremely suitable as a heater for manufacturing semiconductors.

Incidentally, in a planar heater 60 illustrated in FIG. 7, as described above, a carbon wire heat generator W is disposed in the groove-like space formed in the quartz glass support member 61, and the quartz glass support member 61 is integratedly fused except for the space. For this reason, in the planar heater 60, the heat capacity of the quartz glass support member 61 increases, thereby causing a problem of deterioration of responsiveness of the temperature rise and fall.

As a solution of the aforementioned problem, for example, as illustrated in FIG. 8 (a plan view), a configuration in which a plurality of arc-shaped carbon wire heat generators W housed in a protective tube is concentrically disposed on a disk-shaped support base 80 is considered. The plurality of arc-shaped carbon wire heat generators W is enclosed together with a non-oxidizing gas in a quartz glass tube 81 (partially shown) as a protective tube curved in an arc shape.

With such a configuration of the heater, because the heat capacity of the quartz glass tube 81 with the carbon wire heat generator W housed therein is small, there is no problem such as deterioration of the responsiveness of the temperature rise and fall.

Incidentally, in a case where the carbon wire heat generator W is housed in the quartz glass tube 81 curved in an arc shape as in the heater structure illustrated in FIG. 8, it is difficult to stretch the long carbon wire heat generator W in midair. Accordingly, almost all the portion of the carbon wire heat generators W in the longitudinal direction come into contact with the inner peripheral surface of the quartz glass tube 81.

However, when the carbon wire heat generator W and the quartz glass tube 81 are brought into contact with each other, the glass temperature rises and the glass reacts with carbon. Accordingly, the carbon wire breaks; the resistance value of the carbon wire changes; and local heat generation occurs. As a result, there arises a problem of promoting deterioration of the carbon wire heat generator W and of causing the carbon wire heat generator to be liable to break (service life decreases).

Further, when the carbon wire heat generator W is brought into contact with the quartz glass tube 81, the heat from the carbon wire heat generator W is absorbed by the quartz glass tube 81 and the temperature of the heat generator is lowered, which causes deterioration of the heating efficiency of radiant heating.

SUMMARY OF THE INVENTION

The present invention has been made to solve the aforementioned technical problems, and an object thereof is to provide a planar heater wherein a carbon wire heat generator is housed in a long housing portion made of quartz glass; disconnection of the carbon wire heat generator is suppressed by limiting a contact region between the carbon wire heat generator and the long housing portion, and efficient radiation heating is achieved.

In order to solve the above issue, a planar heater according to the present invention is a planar heater in which a carbon wire heat generator is housed in a long housing portion made of quartz glass; the plurality of long housing portions is disposed on the same plane, and heat is generated by the energized carbon wire heat generator, wherein each of the plurality of long housing portions is formed in a polygonal circular arc shape in which a plurality of linear portions is connected to each other at a bent portion, respectively, and the plurality of long housing portions is disposed along circumferences of a plurality of concentric circles.

It is preferable that an intersection angle between the linear portions connected to each other at the bent portion in the long housing portion is 135° or larger and 170° or smaller.

Further, it is preferable that a polygonal circular shape is formed by at least one of the long housing portions, and the polygonal circular shape is disposed in a plurality of concentric circular shape.

Further, it is preferable that the long housing portion is made of a quartz glass tube, or the long housing portion may be a groove portion formed on the quartz glass plate.

According to the above configuration, when the carbon wire heat generator generates heat, deterioration of the carbon wire progresses at certain portions of the carbon wire heat generator, which is liable to come into contact with the bent portion of the long housing portion, but other portions are in a state of being hard to be deteriorated. That is, by restricting the contact region, it is possible to suppress progress of deterioration of the carbon wire as a whole.

Further, because the linear portion of the long housing portion has a configuration which is hard to come into contact with the carbon wire heat generator, heat from the carbon wire heat generator is not absorbed by the long housing portion, the heat generator temperature is maintained, and efficient radiation heating can be performed.

DESCRIPTION OF THE PREFERRED EMBODIMENTS

Figure 1:
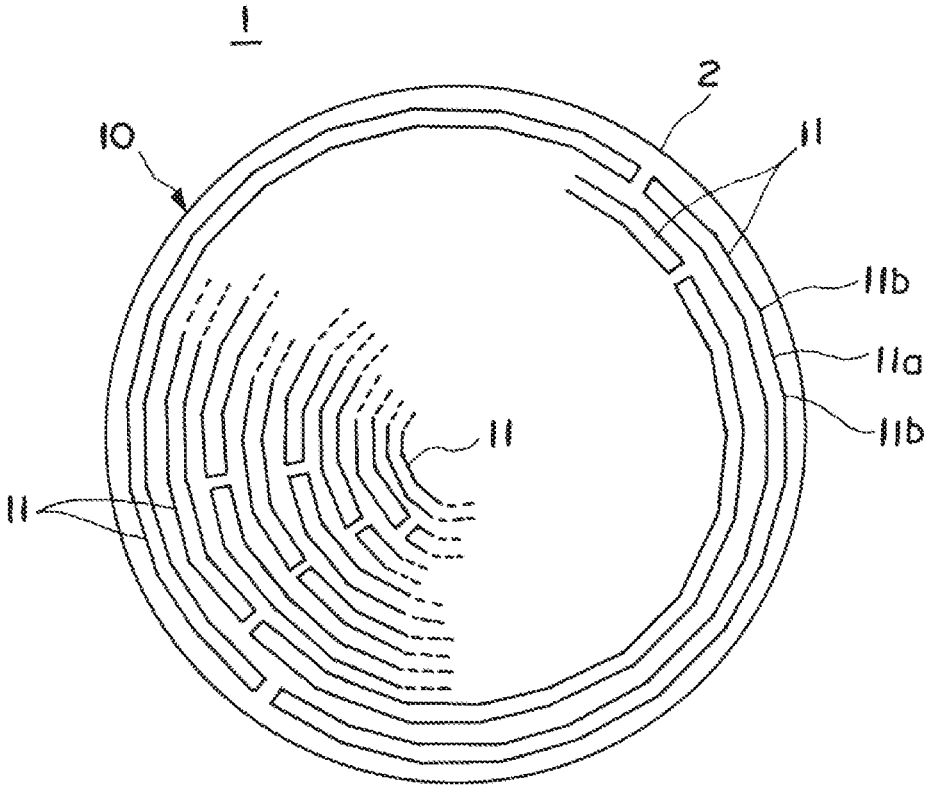
FIG. 1 is a plan view schematically illustrating a planar heater according to the present invention.
Figure 2:
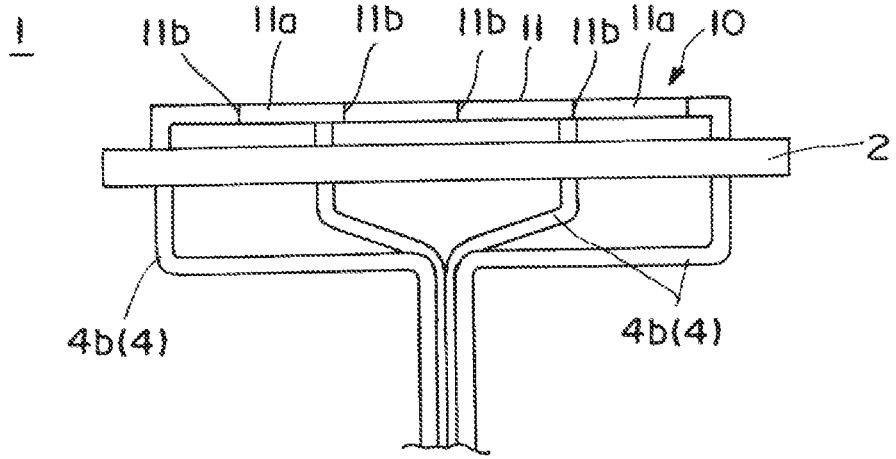
FIG. 2 is a side view of the planar heater of FIG. 1.
Figure 3:
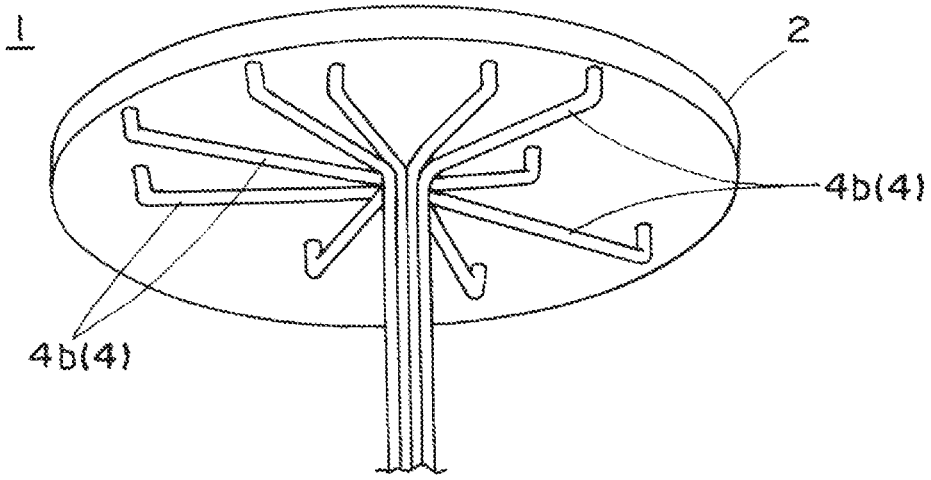
FIG. 3 is a perspective view of the planar heater of FIG. 1 as viewed from below.
Figure 4:
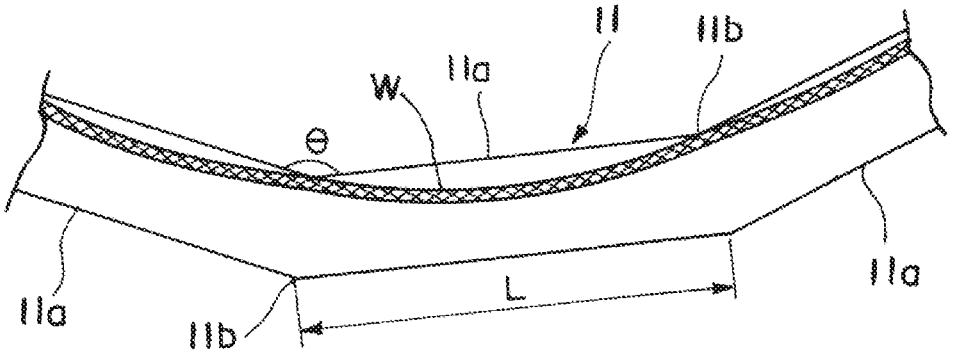
FIG. 4 is a partially enlarged plan view of the heater portion included in the planar heater of FIG. 1.

Hereinafter, embodiments of the present invention will be described with reference to the drawings. FIG. 1 is a plan view schematically illustrating a planar heater according to the present invention, FIG. 2 is a side view of the planar heater of FIG. 1, and FIG. 3 is a perspective view of the planar heater of FIG. 1 as viewed from below. Further, FIG. 4 is a partially enlarged plan view of the heater portion included in the planar heater of FIG. 1.

As illustrated in FIGS. 1 to 3, a planar heater 1 includes a disk-shaped support base 2. In FIG. 2, the support base 2 is supported by a support column (not shown). The support base 2 has a water cooling mechanism.

On a lower surface (back surface) side of the support base 2, a plurality of linear terminal portions 4 is wired, only four of which are shown in FIG. 2 and only ten of which are shown in FIG. 3 for illustration, but actually, the number of the terminal portions is twice the carbon wire heat generators W to be described later. In addition, the plurality of terminal portions 4 is gathered so as to be bundled.

A heater portion 10 is provided on the support base 2. The heater portion 10 has a quartz glass tube 11 (a long housing portion) as a protective tube, and a carbon wire heat generator W (see FIG. 4) enclosed in each quartz glass tube 11 together with an inert gas (non-oxidizing atmosphere gas). As illustrated in FIGS. 1 and 4, the quartz glass tube 11 is formed in a polygonal circular arc shape in which a plurality of linear portions 11*a* is connected to one another, while being bent at the bent portion 11*b*.

Further, as a basic structure of the carbon wire heat generators W housed in the quartz glass tube 11, carbon wires are used, which are knitted into a knitting string shape having a diameter of about 2 mm or a knitted shape, using approximately ten fiber bundles prepared by bundling 3,000 to 3,500 long carbon fibers, having a diameter of 2 to 15 μm approximately, a diameter of 7 μm, for example. In the aforementioned case, the knitting span of the wire is approximately 2 to 5 mm.

As shown in FIG. 1, on the support base 2, for example, one to four quartz glass tubes 11 are connected to form a single circle (polygonal circle) on the same plane, and the quartz glass tubes 11 are formed in a plurality of (eight in FIG. 1) concentric circle shapes.

Further, both ends of the carbon wire heat generator W housed inside each quartz glass tube 11 are connected to the terminal portion 4, respectively.

The terminal portion 4 has a structure in which one end of a connection line (not shown) of made of a carbon wire that is housed in the quartz glass tube is connected to the carbon wire heat generator W, and the other end is connected to a metal power supply terminal (not shown). That is, the carbon wire heat generator W generates heat when the carbon wire heat generator W is energized from the power supply terminal via the connection line.

As described above, the quartz glass tube 11 has a linear portion 11*a* and a bent portion 11*b*. As shown in FIG. 4, by making the quartz glass tube 11 have a configuration (a polygonal circular shape) in which a plurality of linear portions 11*a* is connected to one another at the bent portion 11*b*, a predetermined part of the carbon wire heat generator W comes into contact with the tube inner side portion of the bent portion 11*b*, and the carbon wire heat generator W is hard to come into contact with the linear portion 11*a*.

In the quartz glass tube 11, an intersection angle θ of the linear portions 11*a* on both sides of the bent portion 11*b* is 135° or larger and 170° or smaller, and the length L of each linear portion 11*a* is 60 mm or longer. This is because, when the intersection angle θ is less than 135°, the carbon wire heat generator W strongly comes into contact with the tube inner side portion of the bent portion 11*b* in the quartz glass tube 11, the temperature of the quartz glass tube 11 is liable to rise, and the reaction of the carbon wire heat generator W to be accelerated. Further, when the intersection angle θ is less than 135°, it is difficult to uniformly and at high density dispose the carbon wire heat generators in the plane, and it fails to uniformly heat the object.

Figure 8:
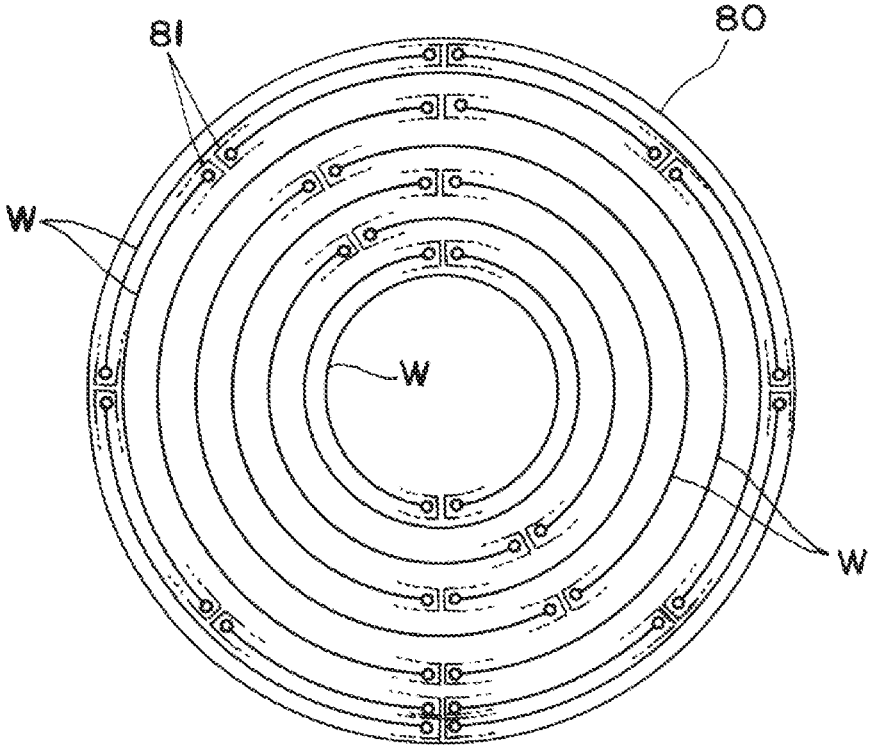
Fig. 8 Prior Art
FIG. 8 is a plan view illustrating another form of a conventional planar heater.

On the other hand, when the intersection angle θ exceeds 170° or when the length L of each linear portion 11*a* is less than 60 cm, the contact region between the quartz glass tube 11 and the carbon wire heat generator W increases, which is the same as the conventional configuration illustrated in FIG. 8.

According to the planar heater 1 configured as described above, when the carbon wire heat generator W generates heat, the deterioration of the carbon wire progresses at a predetermined part of the carbon wire heat generator W that comes into contact with the bent portion 11*b* of the quartz glass tube 11. However, in other parts where the carbon wire is hard to come into contact with the linear portion 11*a*, the carbon wire is in a state of being hard to be deteriorated. That is, by restricting the contact region, it is possible to suppress the progress of deterioration of the carbon wire as a whole.

Further, since the linear portion 11*a* of the quartz glass tube 11 has a configuration that is hard to come into contact with the carbon wire heat generator W, the heat from the carbon wire heat generator W is not absorbed by the quartz glass tube 11; the temperature of the heat generator is maintained, and the efficient radiant heating can be performed.

Figure 5:
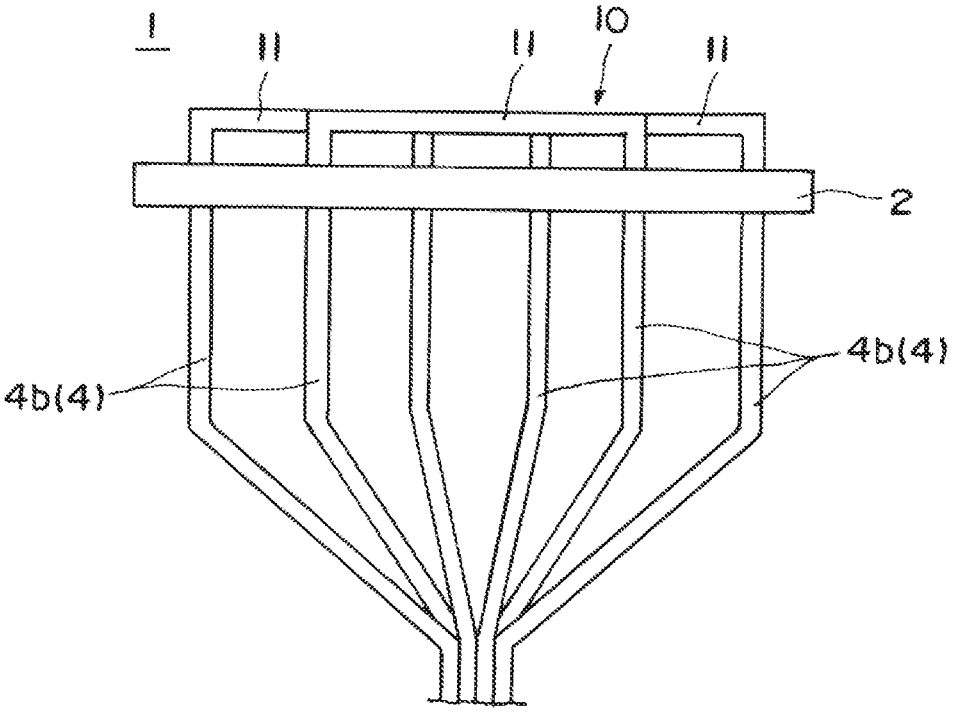
FIG. 5 is a side view illustrating a modified example of the planar heater according to the present invention.

In the aforementioned embodiment, as illustrated in FIGS. 2 and 3, the plurality of terminal lines 4*b* is bundled together just under the support base 2. However, in order to eliminate the influence of the metal power supply terminal on the radiation heating, as illustrated in FIG. 5, the terminal lines may be bundled together at a position spaced from the support base 2. In FIG. 5, although only six terminal lines 4*b* are illustrated for description, actually, the number of the terminal lines is twice the carbon wire heat generators W.

Further, in the aforementioned embodiment, one circle (polygonal circle) is formed by at least one quartz glass tube 11, and the circle is arranged in the shape of a plurality of concentric circles.

However, the present invention is not limited to the configuration, a substantially complete circle (polygonal circle) may not be formed by the quartz glass tube 11, and the quartz glass tube 11 may be partially disposed along the circumferences of a plurality of concentric circles. In this case, for example, for a portion in which the quartz glass tube 11 is not disposed along the circumference, the quartz glass tube 11 is disposed to achieve uniform radiation heating as a whole heater on a concentric circle having a larger diameter or a concentric circle having a smaller diameter.

Further, in the aforementioned embodiment, the quartz glass tube 11 has been described as an example of a long housing portion made of quartz glass, but the planar heater according to the present invention is not limited to that form.

Figure 6:
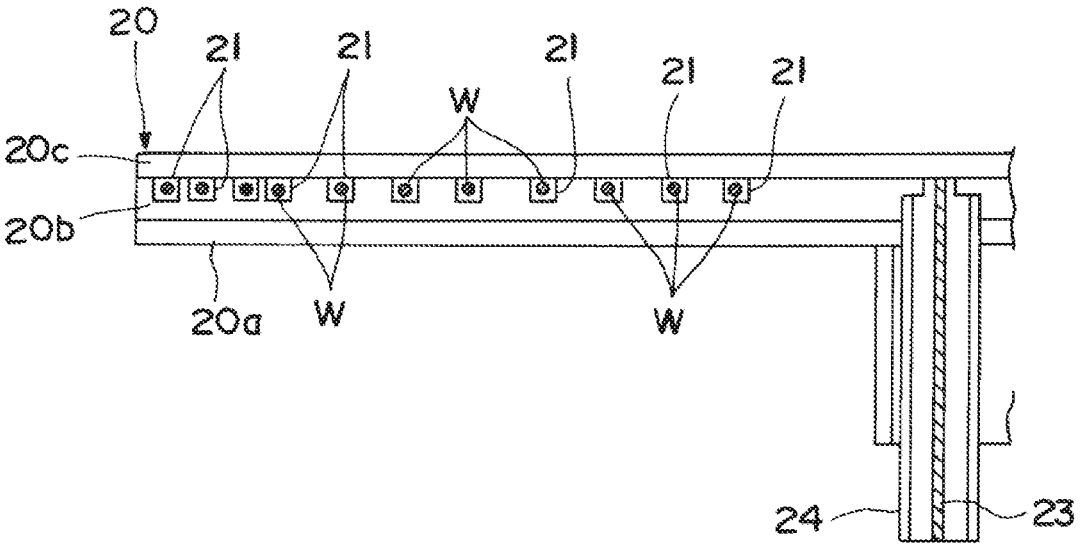
FIG. 6 is a cross-sectional view illustrating another modified example of the planar heater according to the present invention.
Figure 7:
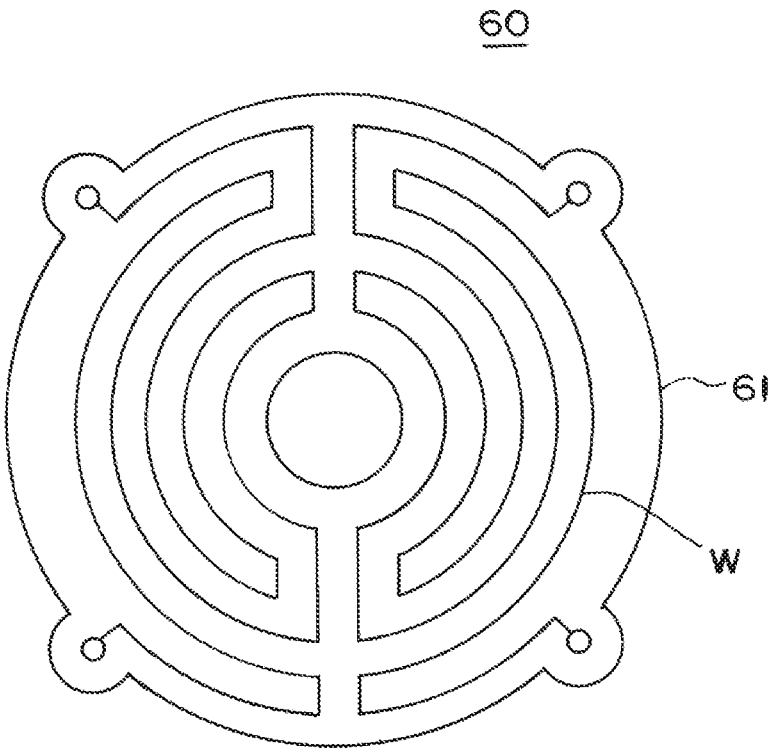
Fig. 7 Prior Art
FIG. 7 is a plan view of a conventional planar heater.

For example, as illustrated in FIG. 6 (a cross-sectional view), a configuration in which the carbon wire heat generator W is enclosed inside the quartz glass plate-like member 20 supported by the support column 24 may be provided. In this case, for example, the quartz glass plate-like member 20 may be formed by a first quartz glass body 20*a*, a second quartz glass body 20*b*, and a third quartz glass body 20*c* which are laminated in order, and a groove portion 21 formed on the upper surface of the second quartz glass body 20*b* may be provided as the long housing portion. Further, the groove portion 21 may have a shape in which a plurality of linear portions is connected at a bent portion, and by housing the carbon wire heat generator W inside the groove portion 21, the contact between the carbon wire heat generator W and the long housing portion (quartz glass) can be limited to the bent portion. That is, it is possible to suppress the breakage of the carbon wire caused by the contact between the carbon wire heat generator W and the quartz glass, thereby suppressing the deterioration and breakage of the carbon wire heat generator W.

Further, in FIG. 6, each carbon wire heat generator W is configured to be energized via the connection line 23 in the support column 24.

the heater portion was set to 110°. Other conditions are the same as those of the first example.

In a third example, the intersection angle between the linear portions at the bent portion in the quartz glass tube of the heater portion was set to 135°. Other conditions are the same as those of the first example.

In a fourth example, the intersection angle between linear portions at the bent portion in the quartz glass tube of the heater portion was set to 170°. Other conditions are the same as those of the first example.

In a fifth example, the intersection angle between the linear portions at the bent portion in the quartz glass tube of the heater portion was set to 175°. Other conditions are the same as those of the first example.

In a first comparative example, as illustrated in FIG. 9, a planar heater in which the carbon wire heat generator is curved along an arc-shaped quartz glass tube was used, and the time until the disconnection of the carbon wire heat generator by applying a current of 33 A was measured.

The results of this test are summarized in Table I. As illustrated in Table I, the time until the disconnection of the carbon wire heat generator became longer in a range in which the intersection angle between the linear portions of the quartz glass tube is 135° or larger and 170° or smaller (first, third and fourth examples), and in other ranges (second and fifth examples) and the first comparative example, a shorter result was obtained.

When the intersection angle is set to 110°, because the carbon wire heat generator and the quartz glass tube strongly come into contact with each other at the bent portion, the temperature of the quartz glass tube rises, the reaction with the carbon wire heat generator is accelerated, and the disconnection of the carbon wire heat generator is considered to be accelerated.

Further, when the intersection angle is set to 175°, since the planar heater is substantially circular and accordingly, the contact region between the quartz glass tube and the carbon w ire heat generator increases, the temperature of the quartz glass tube rises; the reaction with the carbon wire heat generator accelerates, and the disconnection of the carbon wire heat generator is considered to be accelerated.

TABLE I

| | First Example (150°) dodecagonal shape | Second Example (110°) pentagonal shape | Third Example (135°) octagonal shape | Fourth Example (170°) thirty-six angular shape | Fifth Example (175°) seventy-two angular shape | First Comparative Example circular shape |
|---|---|---|---|---|---|---|
| Time until disconnection (h) | 13.8 | 10.2 | 13.5 | 12.4 | 10.2 | 9.8 |

The planar heater according to the present invention will be further illustrated based on examples. In the examples, the disconnection test of the carbon wire heat generator was performed using the planar heater described in the above embodiment, and the effect of the present invention was verified.

In a first example, the planar heater having the configuration of the present invention illustrated in FIGS. 1 to 4 was used, and the time until the disconnection of the carbon wire heat generator was measured at an applied current of 33 A. In addition, the intersection angle between the linear portions at the bent portion in the quartz glass tube was set to 150°, and the length of the linear portion was 70 mm.

In a second example, the intersection angle between the linear portions at the bent portion in the quartz glass tube of From the results of the above examples, according to the planar heater of the present invention, it was confirmed that the breakage of the carbon wire heat generator can be suppressed by limiting the contact region between the carbon wire heat generator and the long housing portion made of quartz glass.

What is claimed is:

1. A planar heater, comprising:

a carbon wire heat generator that is accommodated in each of a plurality of long housing portions made of quartz glass, and the carbon wire heat generator generates heat by energizing; and the plurality of the long housing portions that is disposed on the same plane, wherein each of the plurality of the long housing portions is formed into a polygonal circular arc shape in which a plurality of linear portions is connected to one another at an angle at a bent portion, and the plurality of long housing portions is disposed along circumferences of a plurality of concentric circles.

2. The planar heater according to claim 1, wherein an intersection angle between the linear portions connected to each other at the bent portion in the long housing portion is 135° or larger and 170° or smaller.

3. The planar heater according to claim 1, wherein a polygonal circular shape is formed by at least one of the long housing portions, and the polygonal circular shape is disposed in a plurality of concentric circular shape.

4. The planar heater according to claim 1, wherein the long housing portion is a quartz glass tube.

5. The planar heater according to claim 1, wherein the long housing portion is a groove portion formed on a quartz glass plate.

* * * * *